US005150938A

United States Patent [19]

Gans

[11] Patent Number: 5,150,938

[45] Date of Patent: Sep. 29, 1992

[54] BAG GRIP

[76] Inventor: David L. Gans, 50 Laguna St., Apt. 308, San Francisco, Calif. 94102

[21] Appl. No.: 697,572

[22] Filed: May 9, 1991

[51] Int. Cl.[5] ..... B65D 33/06

[52] U.S. Cl. ..... 294/156; 294/153; 294/158; 294/170; 383/13

[58] Field of Search ..... 294/31.2, 27.1, 137, 294/145, 148–159, 162–171; 16/114 R, 114 B, 119, 125; 224/103; 229/117.23–117.25; 383/6, 13, 24–26, 29

[56] References Cited

U.S. PATENT DOCUMENTS

| | | | |
|---|---|---|---|
| 2,224,161 | 12/1940 | Rice | 383/13 |
| 3,137,421 | 6/1964 | Haddock | 224/103 |
| 3,636,594 | 1/1972 | Faivre | 294/137 X |
| 4,730,863 | 3/1988 | Guadnola | 294/156 |
| 4,772,059 | 9/1988 | Parry et al. | 294/158 X |

FOREIGN PATENT DOCUMENTS

| | | | |
|---|---|---|---|
| 500407 | 3/1952 | Belgium | 294/153 |
| 558835 | 6/1958 | Canada | 294/158 |
| 7888 | 2/1980 | European Pat. Off. | 294/137 |
| 249373 | 7/1912 | Fed. Rep. of Germany | 294/137 |
| 113180 | 2/1918 | United Kingdom | 294/158 |

*Primary Examiner*—Johnny D. Cherry
*Attorney, Agent, or Firm*—Douglas E. White

[57] ABSTRACT

A detachable grip supplements the handle pair of a single plastic bag, or the handle pairs of a number of bags. The grip has a bar which comfortably fits in the palm of the hand. One end of a cord (which cord could be wire, line, belt or cable) is permanently attached to one end of the bar. The other end of the cord has apparatus for removably latching itself to the other end of the bar, temporarily forming a closed loop of fixed length. The distance along the handle between the two ends is at least as wide as an adult human's hand. The latching apparatus preferably is a stop, such as a ball or a cylinder, on the free end of the cord, which ball or cylinder fits into a socket on the free end of the bar. However, other latches or clasps are disclosed for use as substitutes for the stop and socket latch.

6 Claims, 3 Drawing Sheets

BAG GRIP

FIELD OF THE INVENTION

This invention relates to handling and carrying devices, more particularly to a grip for holding plastic shopping bags.

BACKGROUND OF THE INVENTION

The conservation movement has prompted a switch from paper shopping bags to bags made of plastic. Plastic shopping bags normally have a pair of cut-out holes which form a pair of loop handles. These handles are made of very thin material which cuts into one's fingers—particularly when the bag is full of heavy items. This problem is exacerbated when one tries to carry many full bags in one hand.

Furthermore, if one puts down a two-handled plastic bag, the handles separate and the contents are liable to spill. This problem, too, is multiplied when one is carrying more than one bag. To re-grip the handles of one or more bags which have separated in this way is both annoying and time-consuming.

Prior developments in this field may be generally illustrated by reference to the following patents:

| U.S. Pat. No. | Patentee | Issue Date |
|---|---|---|
| 3,257,054 | J. Miesel | Jun. 21, 1966 |
| 4,529,240 | A. Engel | Jul. 16, 1985 |
| 2,819,923 | D. Anderson | Jan. 14, 1958 |
| 3,119,160 | W. Hoppeler | Jan. 28, 1964 |
| 3,636,594 | B. Faivre | Jan. 25, 1972 |

U.S. Pat. No. 3,257,054 teaches a carrier that has a cable with a key-like structure 142 on one end that fits into a slot in a clamp 113 to form a carrying loop. The other end of the cable, however, is free to slide in its bore 124, so the size of the loop 158 is not fixed.

U.S. Pat. No. 4,529,240 teaches a key and slot sleeve 11 that forms a loop for a carrying device used in the transport of deer. A handle 27 is required, which handle is separate from the sleeve 11.

The rest of the patents are representative of what is in the art.

SUMMARY OF THE INVENTION

The present invention is a detachable grip for supplementing the handle pair of a single plastic bag, or the handle pairs of a number of such bags. The grip has a bar which comfortably fits in the palm of the hand. One end of a cord (which cord could be wire, line, belt or cable), comprising looping means, is permanently attached to one end of the bar. The other end of the cord has means for removably latching itself to the other end of the bar, temporarily forming a closed loop of fixed length. The distance along the handle between the two ends is at least as wide as an adult human's hand. The latching means preferably is a stop, such as a ball or cylinder, on the free end of the cord, which ball or cylinder fits into a socket on the free end of the bar. However, other latches or clasps can be used as substitutes for the stop and socket latch.

The device is used by threading the free end of the cord through the holes in the bag which form the pair of plastic bag handles. Further threading of the free end of the cord through a slot in the free end of the bar, captures the ball or cylinder in the socket. This secures both bag handles within the looping means thus formed.

The bar may be molded so as to be comfortable when carrying heavy loads. The bag handles will not pull apart when the bag is temporarily put down.

Several bags may have their handle pairs captured by the closed loop of the grip and all may be comfortably carried at the same time. Their contents do not spill out when they are put down. The handles of the bag or bags tend to slide together on the cord of the grip during transport, further sealing the bags.

FEATURES AND ADVANTAGES

An object of this invention is to provide grip apparatus for a shopping bag of the type having two handles which includes a bar having first and second ends and looping means having an attached end and a free end, the attached end of the looping means affixed to the first end of the bar, and the free end of the looping means having latching means for releasably securing the free end to the second end of the bar, whereby the looping means may fixedly engage the bag handles and the bag may be carried by grasping the bar.

Another feature of the invention is to have the length of the bar between the attached end of the looping means and the free end of the looping means to be at least 3 inches, to accommodate the width of the human hand.

In some embodiments of the invention, a flexible cord is featured as the looping means.

In one embodiment, the latching means is a stop on the free end of the cord. This embodiment further includes a socket on the second end of the bar into which socket the stop may be releasably secured.

Another feature of this embodiment is a slot in the second end of the bar communicating with the socket, through which slot the cord may releasably travel.

In another embodiment, the latching means is a shackle on the free end of the cord. There is a socket on the second end of the bar, into which socket the shackle may be releasably secured.

This and other embodiments may include a cover on the cord for padding.

In yet another embodiment, the looping means is a rigid rod.

Further features of the immediately previous embodiment are a longitudinal socket in the second end of the bar and means for engaging the free end of the rod into the socket.

Yet another feature of this embodiment is an aperture in the first end of the bar, into which aperture the attached end of the rod is slideably affixed.

Still another feature of this embodiment is a spring in the aperture biased against the attached end of the rod.

This embodiment may further include a mid-section of the rod having a convex upper surface and a concave lower surface.

Yet another embodiment includes a bar having first and second transverse sections, each section having first and second longitudinal ends, each section having a length of between 3 to 5 inches between the first and second ends thereof; includes an "X"-shaped web connecting the first and second sections of the bar, the web connected to the first and second ends of each section; and includes latching means for releasably securing the first section of the bar to the second section of the bar, whereby the web may fixedly engage the bag handles and the bag may be carried by grasping the bar.

This and other embodiments may further include finger grooves for comfort in the lower side of the bar.

Another feature is an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

DRAWING REFERENCE NUMERALS

Figure 1:
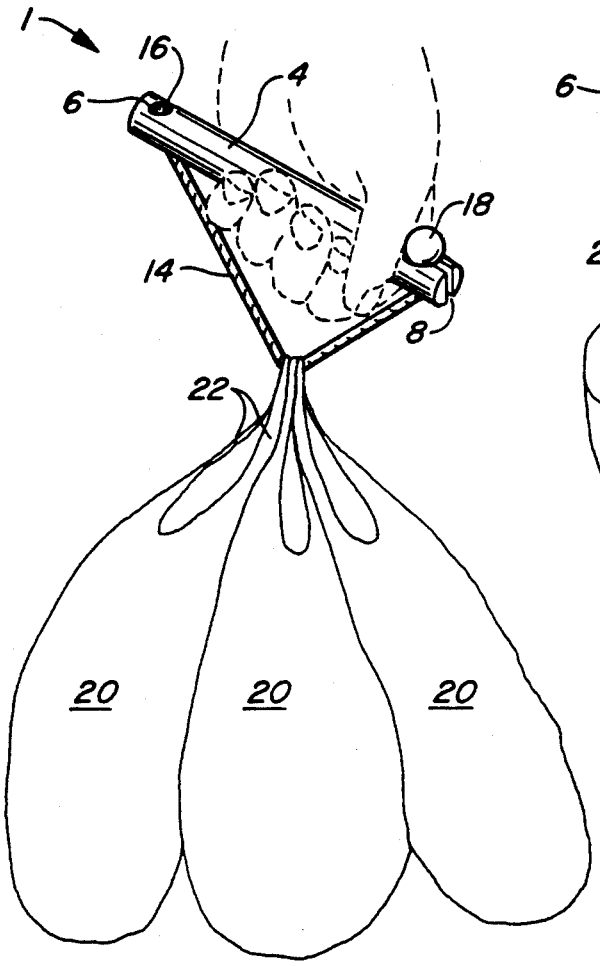
FIG. 1 is a perspective view of a preferred bag grip of this invention, showing it in combination with shopping bags.

1 bag grip
4 bar of 1
6 aperture in 4
8 slot in 4
10 socket in 4
14 cord of 1
16 knot in 14
18 stop on 14
20 bag
22 handle of 20
24 hole in 20
101 bag grip
104 bar of 101
110 socket in 104
114 wire or cord of 101
115 cover of 114
118 shackle on 114
201 bag grip
204 bar of 201
206 aperture in 204
207 spring in 206
210 socket in 204
214 rod of 201
216 attached end of 214
217 mid-section of 214
218 free end of 214
222 bag handle
301 bag grip
304 bar of 301, left portion
305 bar of 301, right portion
310 socket in 305
311 post and stop tongue on 304
312 finger grooves in 304, 305
314 web of 301
317 mid-section of 314

DESCRIPTION OF A PREFERRED EMBODIMENT

Figure 2:
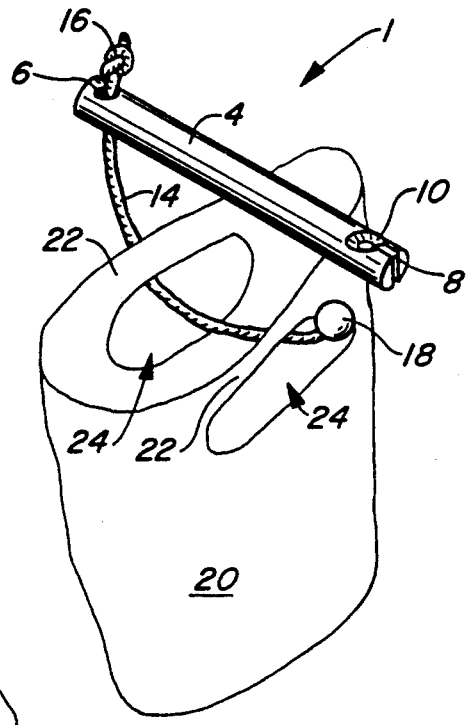
FIG. 2 is a perspective view of the grip of FIG. 1, showing it in a second position.

Referring to FIGS. 1 and 2, there is illustrated therein a bag grip 1 of this invention, shown attached in combination with three plastic shopping bags 20 of existing design. The grip 1 is comprised of a handle or bar 4 and a flexible cord or wire looping means 14. The bar 4 has a well or closed circular transverse aperture 6 at a first end. The second end of the bar has a slot 8 leading to a concave circular socket 10, which socket tapers to a cylindrical transverse aperture that opens out to the bottom of the bar.

A knot 16 may be formed in one end of the cord 14 for more or less permanently attaching the cord to the bar within the aperture 6. Alternatively, the attached end of the cord could be glued in place at one end of the bar or otherwise affixed thereto.

The other end of the cord, referred to herein as the free end, terminates in a stop 18 or other latching means, such as a ball or a cylinder or another object of predetermined shape. As shown in FIG. 2, the stop and the free end of the cord may be threaded through the two holes 24 that are cut or stamped out of the side walls of each shopping bag 20, which holes form the two handles 22 of the bag. Once so threaded, the handles 22 are captured by the cord 14. The free end of the cord then may be threaded through the slot 8 in the bar 4 until the stop 18 rests securely in its socket 10.

It is to be understood that the ball stop 18 may be replaced by any object of predetermined shape, as long as its shape (at least at the bottom) is closely matched by the shape of the socket 10, so that the stop is held securely in the socket when the cord 14 is pulled down by the weight of bags 20. For example, a cylindrically-shaped latching means or stop has been determined to be both functional and cost-effective when combined with a congruent cylindrical socket. For this reason, the term "stop and socket" latch as used herein, shall refer to any such latch where the object on the end of the cord is of a shape which is closely congruent to the shape of the socket on the bar. The term "stop" shall include balls and functionally equivalent objects, such as cylinders.

The socket 10 may be made deeper than illustrated, so that the stop 18 snaps tightly in place, if so desired. Once latched, the loop formed by the cord 14 is of fixed length and able to support great weight. The distance along the bar 4 between the fixed end and the free end of the cord 14 is at least as wide as an adult human's hand—preferably between 3 and 5 inches.

As can be seen in FIG. 1, any comfortable number of bags 20 may be so captured. Their weight forces the cord into a "V" shape so that the pairs of handles 22 of the bags 20 all tend to slide together. This compacts the bags and their contents for convenient transport. Furthermore, this closure of the handles renders the contents of the bags less likely to spill. The protection against spilling remains to some extent, even when the grip 1 is temporarily set down, as long as the stop and socket latch is not released. The grip 1 and its threaded bags 20 then may be picked up together again without need to re-thread the grip.

Figure 3:
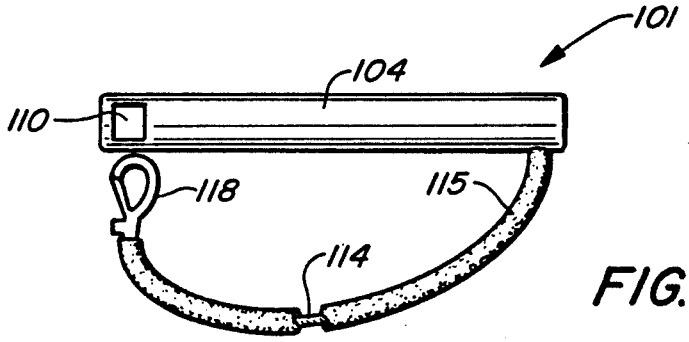
FIG. 3 is a frontal elevation of a second embodiment of the bag grip.

FIG. 3 illustrates an alternate bag grip 101 of this invention. It is to be noted that, for convenience, the last two positions of the reference numerals of alternate embodiments of the invention duplicate those of the numerals of the embodiment of FIG. 1, where reference is made to similar or corresponding parts.

The grip 101 is comprised of a bar 104 and a flexible cord (preferably wire) looping means 114. The bar 104 has a socket 110 at one end forming a clasp ring which passes through the bar. Although illustrated as square, the socket 110 could be round, oval, or any other suitable shape. One end of the wire 114 is glued or otherwise permanently attached to the bar at the end opposite from the clasp ring 110.

The other end of the wire, the free end, terminates in a shackle 118, comprising latching means. The wire 114 may be padded or have a cover 115, in order that thin, but strong, stock may be used without cutting through the thin plastic of the shopping bag handles. The shackle latch 118 of the wire 114 is threaded through the handle holes of shopping bags, in the manner of the previous embodiment, and connected to the socket 110.

Figure 4:
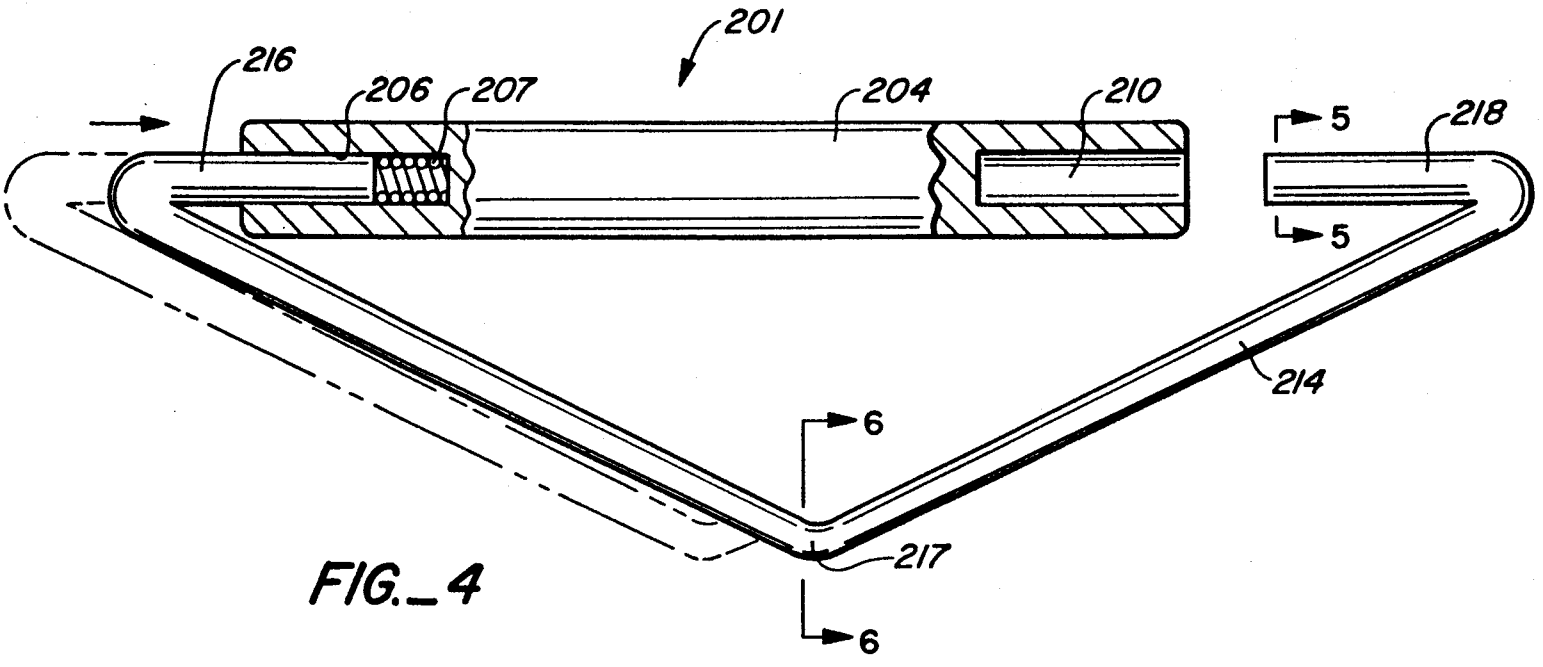
FIG. 4 is a frontal elevation in partial section of a third embodiment of the invention.
Figure 6:
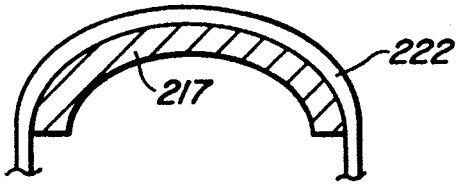
FIG. 6 is a sectional side elevation of the rod of the grip of FIG. 4, taken along line 6—6 of FIG. 4.
Figure 5:
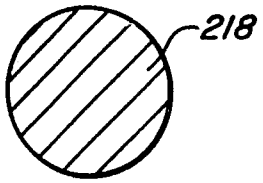
FIG. 5 is a sectional side elevation of the rod of the grip of FIG. 4, taken along line 5—5 of FIG. 4.

FIGS. 4–6 illustrate a third bag grip 201 of this invention. The grip 201 is comprised of a bar 204 and a rigid bent or molded rod 214, comprising looping means. The bar 204 has a longitudinal aperture 206 at one end into which is slideably affixed an attached end 216 of the rod 214. The attached end 216 is long enough so that, once in the aperture 206, it never slides free.

The other end 218 of the rod 214, the free end, slideably fits into a congruent longitudinal socket 210 in the other end of the bar, to comprise latching means. However, the free end 218 is short enough that, when the attached end is fully pressed into the aperture 206, the free end is retracted out of the socket 210. This retracts it a sufficient distance to form a gap between the free end 218 and the bar, into which gap may be threaded bag handles 222 (see FIG. 6).

The aperture 206 may have an embedded spring 207 which is biased against the attached end 216 of the rod 214. The spring will automatically force the gap closed after the bag handles have been inserted and the free end is released. Alternatively, the attached end 216 can be threaded into the aperture 206 through matching screw threads, so that the gap will open and close as the bar 204 is rotated about the end 216. In either event, varying the length in which the fixed end 216 of the rod 214 is embedded in the aperture 206 comprises means for engaging the free end 218 within the socket 210.

The rod 214 may have a constant circular cross-section, such as the cross-section of its free end—as shown in FIG. 5. However, material may be saved, and the bag handles 222 prevented from tearing, if the mid-section 217 of the rod is formed with a convex handle-carrying upper surface and a concave lower surface, as shown in FIG. 6.

Figure 7:
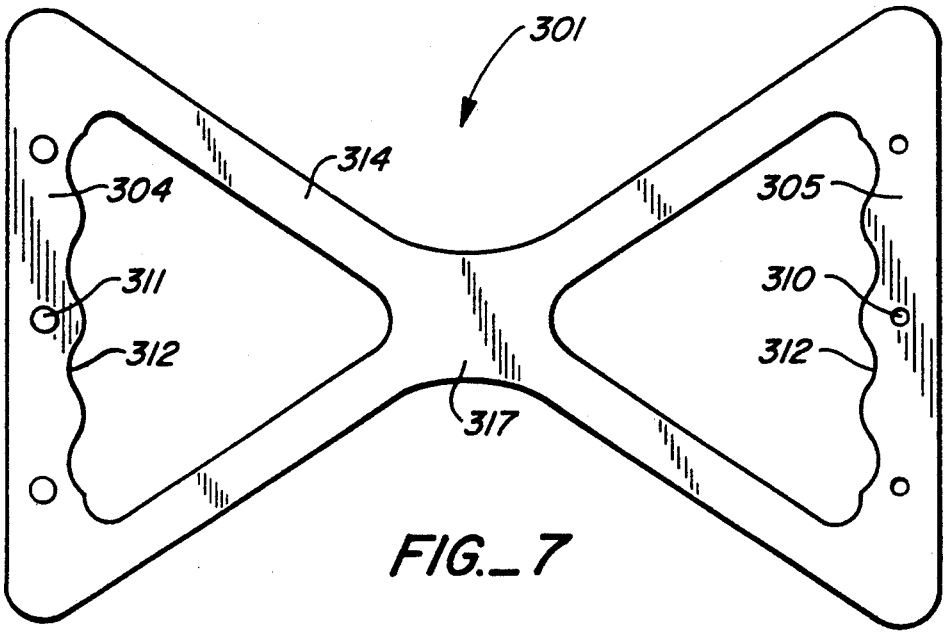
FIG. 7 is a plan view of a fourth embodiment of the grip of this invention.
Figure 8:
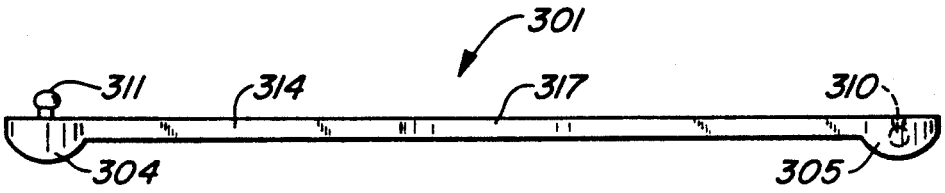
FIG. 8 is a frontal elevation of the grip of FIG. 7.
Figure 9:
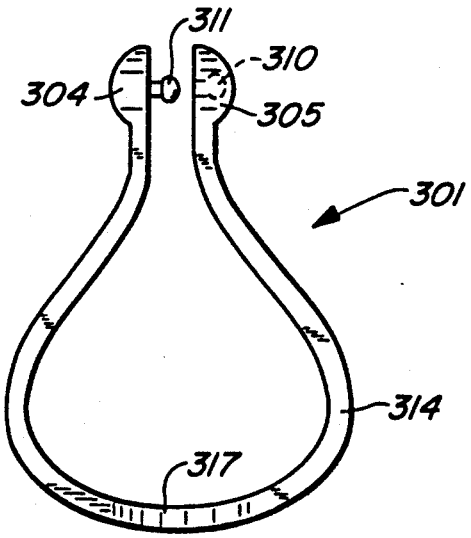
FIG. 9 is a frontal elevation of the grip of FIG. 7 in a second position.

FIGS. 7–9 illustrate yet another alternate embodiment of this invention, namely bag grip 301. The grip 301 is comprised of a bar split into two transverse sections or portions: left portion 304 and right portion 305. The left bar portion 304 has one or more protruding post-and-stop tongues 311, comprising latching means, which tongues match up with congruent sockets 310 in the right bar portion 305 when the grip 301 is folded about its mid-section 317 (see FIG. 9). The two portions 304, 305 of the bar are connected together at the first and second longitudinal ends of each by an "X"-shaped web 314, which web acts as the looping means when the grip is so folded.

The grip 301 may be employed by threading one of the bar portions through the holes which form the handles on a plastic shopping bag (not illustrated). The grip may then be snapped shut by mating the tongues 311 within the sockets 310. The shopping bag handles will be forced by gravity to travel down to the mid-portion 317 of the web 314, whereupon the bags will be held together in a secure and closed fashion. The grip 301 will not become unlocked should the bags be temporarily set down.

Finger-contour grooves 312 may be incorporated into the two bar portions 304, 305, as illustrated in FIG. 7. It is to be noted that, for comfort, such grooves can be incorporated into any of the previous embodiments, as well.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, capacities, sizes, operational features or the like. Therefore, the above description and illustrations should not be construed as limiting the scope of the invention which is defined by the appended claims.

What is claimed is:

1. Grip apparatus for a shopping bag of the type having two handles, including:

a bar having first and second ends;

a flexible cord having an attached end and a free end, the attached end of the cord affixed to the first end of the bar and the free end of the cord having a stop of fixed predetermined shape for releasably securing the free end of the cord to the second end of the bar;

a socket in the second end of the bar, into which socket the stop may be releasably secured, at least one portion of the shape of the socket being closely congruent to at least one portion of the shape of the stop, the socket leading to a transverse aperture in the second end of the bar for directing the free end of the cord out of the socket when the stop is secured in the socket; and a slot in the second end of the bar communicating with the socket and the aperture, through which slot the cord may releasably travel, whereby the cord may fixedly engage the bag handles and the bar may be carried by grasping the bar.

2. The apparatus of claim 1 wherein:

the length of the bar between the attached end of the cord and the free end of the cord, when the free end of the cord is secured to the bar, is at least 3 inches.

3. The apparatus of claim 1 wherein:

the stop is a spherical ball, and the socket is spherically concave.

4. The apparatus of claim 3 wherein:

the aperture is cylindrical.

5. In combination with a plastic shopping bag of the type having two handles formed by a pair of holes separately cut out from opposite sides of the bag, grip apparatus including:

a bar having first and second ends;

a flexible cord having an attached end and a free end, the attached end of the cord affixed to the first end of the bar and the free end of the cord terminating with a spherical ball for releasably securing the free end of the cord to the second end of the bar;

a spherically concave socket in the second end of the bar into which socket the ball may be releasably secured; and a slot in the second end of the bar communicating with the socket, through which slot the cord may releasably travel, the cord being looped through the pair of holes to fixedly engage the bag handles when the ball has secured the free end of the cord to the second end of the bar.

6. The combination of claim 5 wherein:

the socket leads to a transverse cylindrical aperture for directing the free end of the cord out of the socket when the ball is secured in the socket, and the length of the bar between the attached end of the cord and the free end of the cord, when the free end of the cord is secured to the bar, is from 3 to 5 inches.

* * * * *